US006473286B1

(12) United States Patent
Itabashi et al.

(10) Patent No.: US 6,473,286 B1
(45) Date of Patent: Oct. 29, 2002

(54) ELECTROMAGNETIC DEVICE DRIVING APPARATUS

(75) Inventors: Toru Itabashi, Anjo (JP); Masahiro Karami, Toyoake (JP)

(73) Assignee: Denso Corporation, Kariya (JP)

( * ) Notice: Subject to any disclaimer, the term of this patent is extended or adjusted under 35 U.S.C. 154(b) by 268 days.

(21) Appl. No.: 09/634,372

(22) Filed: Aug. 7, 2000

(30) Foreign Application Priority Data

Aug. 9, 1999 (JP) ..... 11-225418

(51) Int. Cl.[7] ..... H01H 9/00; F02M 51/00
(52) U.S. Cl. ..... 361/154; 123/490
(58) Field of Search ..... 361/154; 123/490, 123/499

(56) References Cited

U.S. PATENT DOCUMENTS 4,180,026 A 12/1979 Schulzke et al. ..... 361/154
RE32,035 E * 11/1985 Kuroiwa et al. ..... 361/154
4,605,983 A 8/1986 Harvey ..... 361/154
4,680,667 A 7/1987 Petrie ..... 361/154
4,706,619 A * 11/1987 Bucl ..... 123/90.11
5,546,268 A * 8/1996 Hurley et al. ..... 361/154
6,005,763 A * 12/1999 North ..... 361/154
6,332,454 B1 * 12/2001 Itabashi et al. ..... 123/490

* cited by examiner

*Primary Examiner*—Adolf Deneke Berhane
(74) *Attorney, Agent, or Firm*—Nixon & Vanderhye, P.C.

(57) ABSTRACT

A driving apparatus for an electromagnetic valve comprises a conduction control circuit and a current-limit-value setting circuit. The conduction control circuit turns on and off an FET so that a conduction current flowing through the electromagnetic valve has a magnitude equal to a predetermined current limit value while a microcomputer is outputting a driving signal to the conduction control circuit. The predetermined current limit value is set at a first current limit value during a first predetermined period starting at a point of time the microcomputer outputs the driving signal. When the predetermined first period has lapsed, the predetermined current limit value is switched to a second current limit value for a second period. The second limit value is smaller than the first current limit value. A first off-time of the FET for attaining the first current limit value is set to be shorter than a second off-time of the FET for attaining the second current limit value. Alternatively, a first on-time of the FET for attaining the first current limit value is set to be shorter than a second on-time of the FET for attaining the second current limit value in the second period.

11 Claims, 11 Drawing Sheets

ELECTROMAGNETIC DEVICE DRIVING APPARATUS

CROSS REFERENCE TO RELATED APPLICATION

This application relates to and incorporates herein by reference Japanese Patent Application No. 11-225418 filed on Aug. 9,1999.

BACKGROUND OF THE INVENTION

The present invention relates to an apparatus for driving an electromagnetic device, which may be used for supplying fuel to an engine of a vehicle.

A conventional electromagnetic device driving apparatus of this type is disclosed in USP 4,605,983 (JPB2-4-42805).

When this apparatus is applied to a high-pressure fuel pump, a conduction current flowing through a coil employed in an electromagnetic valve is driven to reach a predetermined magnitude Ip before a predetermined period of time lapses after the start of the valve driving so that the movable body of the valve may be actuated quickly. Thereafter, the conduction current is reduced to a small holding magnitude Ih (<Ip) which is large enough only for holding the movable body of the valve at the current position. As a result, a good driving response of the electromagnetic valve or the operating response of the valve body can be attained by merely supplying a reduced conduction current or a reduced driving current.

In the above current control, a switching device such as a MOSFET is connected in series with the coil of the electromagnetic valve and on/off-controlled to maintain the magnitude of the conduction current. When the switching device is turned off, an arc-extinguishing current Iex flows. It is likely that this arc-extinguishing current influences a conduction current, which flows in the coil, when the MOSFET is turned on next time. Thus, the valve driving characteristics is lessened.

The above problem occurs irrespective of the type of the electromagnetic valve, that is, a normally closed-type or a normally open-type. In addition, the above problem is also encountered in the case of an electromagnetic valve employed as a fuel injector (a fuel injection valve) for supplying fuel to the engine.

SUMMARY OF THE INVENTION

It is thus an object of the present invention to provide an electromagnetic device driving apparatus capable of ensuring a good driving characteristic.

According to the present invention, a driving apparatus for an electromagnetic device comprises a conduction control circuit. The conduction control circuit turns on and off a switching device so that a conduction current flowing through the electromagnetic device has a magnitude at around a predetermined current limit value while a driving signal is applied to the conduction control circuit. The predetermined current limit value used in the conduction control circuit is set at a first current limit value during a first predetermined period from a start of the driving signal. When the predetermined first period has lapsed, the predetermined current limit value is switched to a second current limit value for a predetermined second period. The second limit value is smaller than the first current limit value.

A first off-time of the switching device for attaining the first current limit value in the first period is set to be shorter than a second off-time of the switching device for attaining the second current limit value in the second period. Alternatively, a first on-time of the switching device for attaining the first current limit value in the first period is set to be shorter than a second on-time of the switching device for attaining the second current limit value in the second period.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
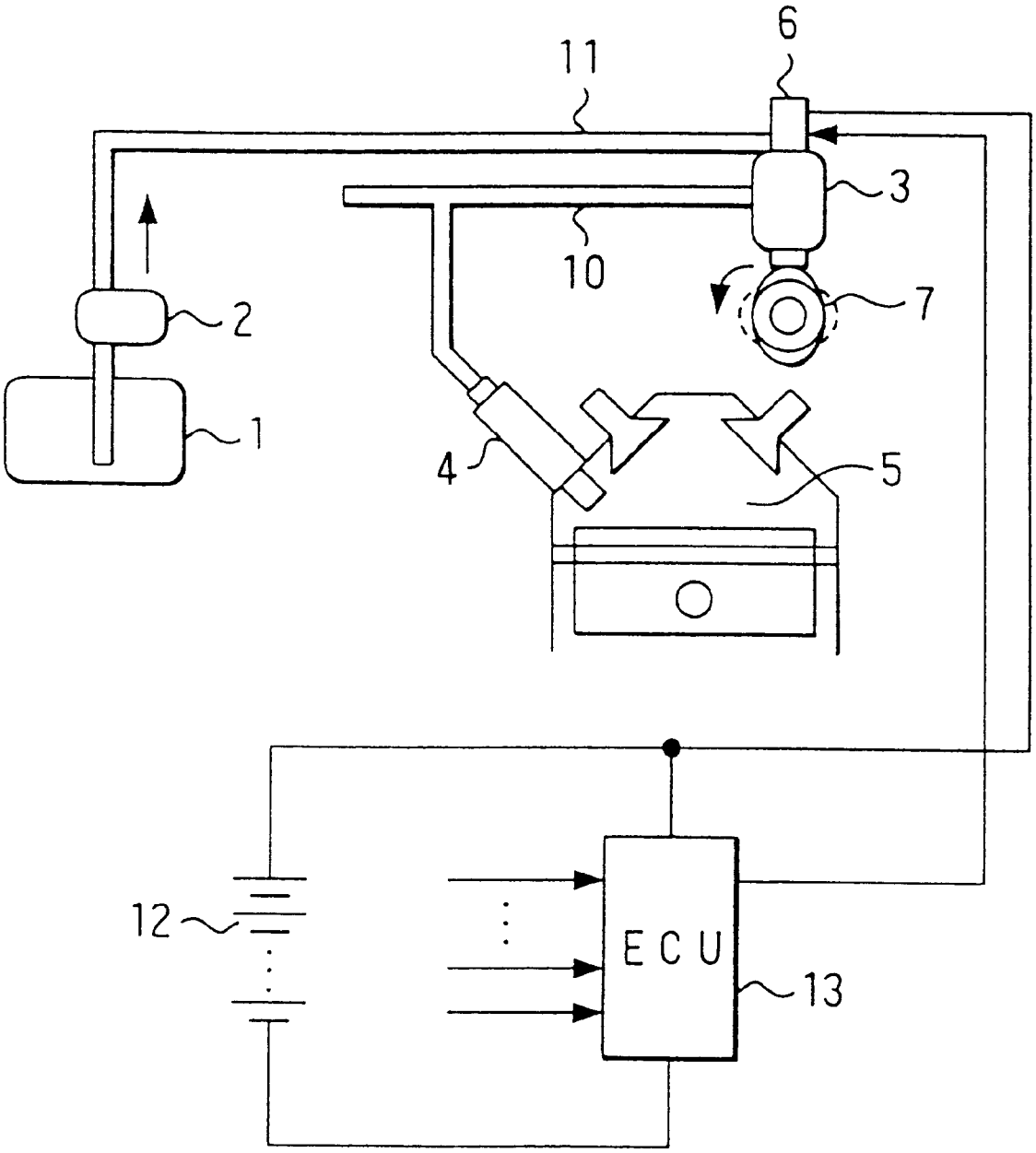
FIG. 1 is a schematic diagram showing a control system of a direct-injection type gasoline engine to which the present invention is applied.

The present invention will be described in further detail with reference to embodiments that are directed to a control system of a direct-injection type gasoline engine. The same or similar reference numerals designate the same or similar parts throughout the embodiments.

In a gasoline engine control system shown in FIG. 1, fuel is supplied from a fuel tank 1 through a low-pressure pump 2 to a high-pressure fuel pump 3 which raises the pressure of the fuel to a predetermined value before supplying the fuel to an injector (electromagnetic fuel injection valve) 4. The injector 4 then directly injects the fuel into a fuel chamber 5 of the engine.

Figure 2:
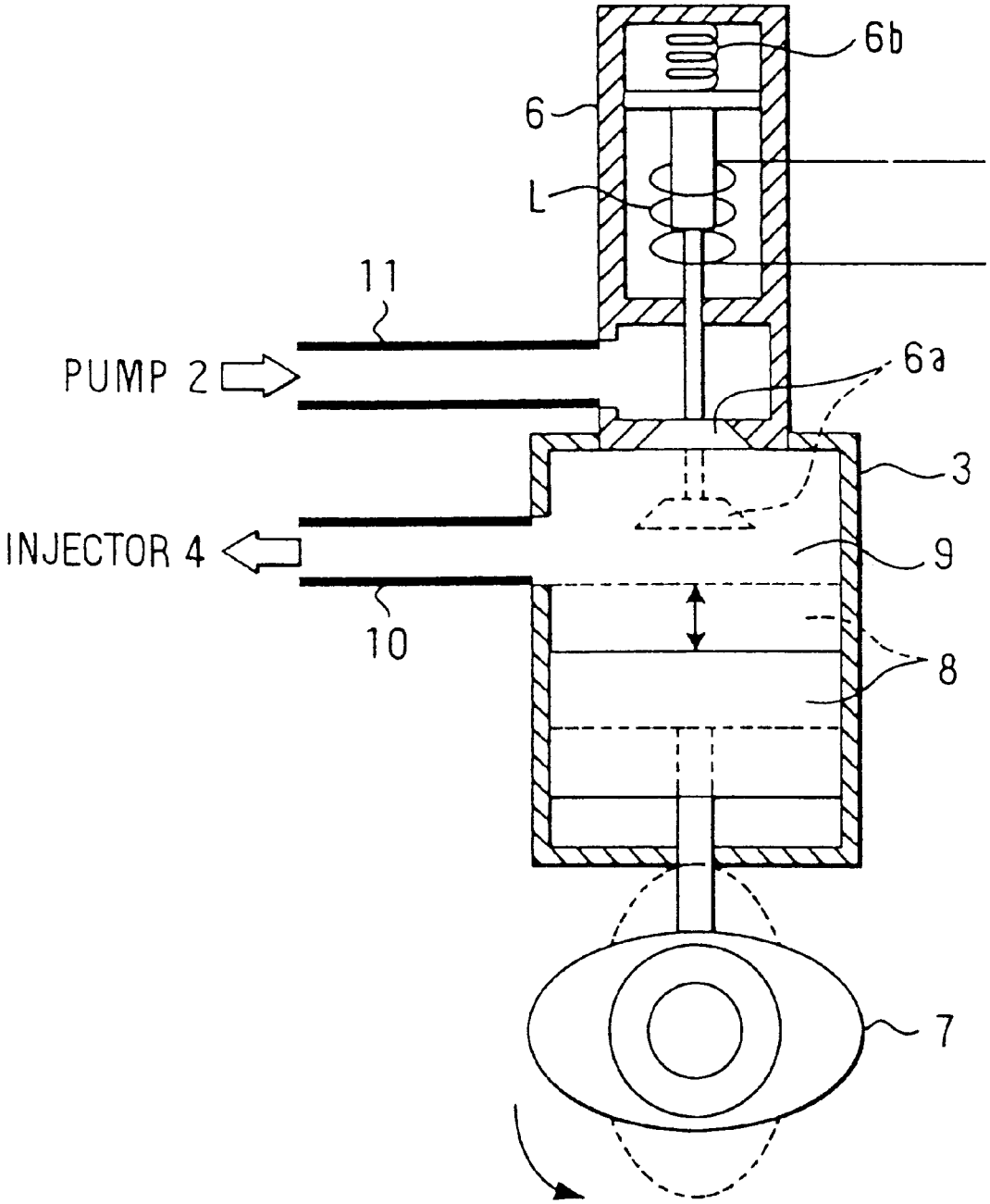
FIG. 2 is a schematic sectional view showing a high-pressure fuel pump used in the system shown in FIG. 1.

As shown in FIG. 2, the high-pressure fuel pump 3 is provided with an electromagnetic valve 6, a piston 8 moving reciprocally in accordance with the rotation of a camshaft 7 of the engine, and a fuel chamber 9 which is linked to the injector 4 by a fuel supply path 10 and has its volume increasing and decreasing with the reciprocal movement of the piston 8.

It should be noted that, the electromagnetic valve 6 is a valve of a normally-open type. That is, in the electromagnetic valve 6, when no current is supplied to a coil L, a movable valve body 6*a* is biased downward in the figure by the biasing force of a return spring 6*b* to an opened-valve position which links a fuel supply path 11 from the low-pressure pump 2 to the fuel chamber 9. When a current is supplied to the coil L, on the other hand, the valve body 6*a* is attracted upward, resisting the biasing force of the return spring 6*b* to a closed-valve position which blocks the fuel supply path 11 from the low-pressure pump 2 to the fuel chamber 9.

When the piston 8 moves downward to supply fuel from the low-pressure pump 2 to the fuel chamber 9 in the high-pressure fuel pump 3, the coil L of the electromagnetic valve 6 is put in a deenergized state to move the valve body 6*a* to the open-valve position, opening the electromagnetic valve 6. When the piston 8 moves upward to raise the pressure in the fuel chamber 9 for discharging the fuel in the fuel chamber 9 to the injector 4, on the other hand, the current flows through the coil L of the electromagnetic valve 6 to move the valve body 6*a* to the closed-valve position, closing the electromagnetic valve 6.

The conduction timing and the conduction duration of the coil L employed in the electromagnetic valve 6 are controlled by an electronic control unit (ECU) 13 shown in FIG. 1, that is used as an electromagnetic valve driving apparatus, synchronously with the rotations of the camshaft 7 and the crankshaft of the engine. The driving apparatus receives electric power from a battery 12 mounted on a vehicle.

First Embodiment

Figure 3:
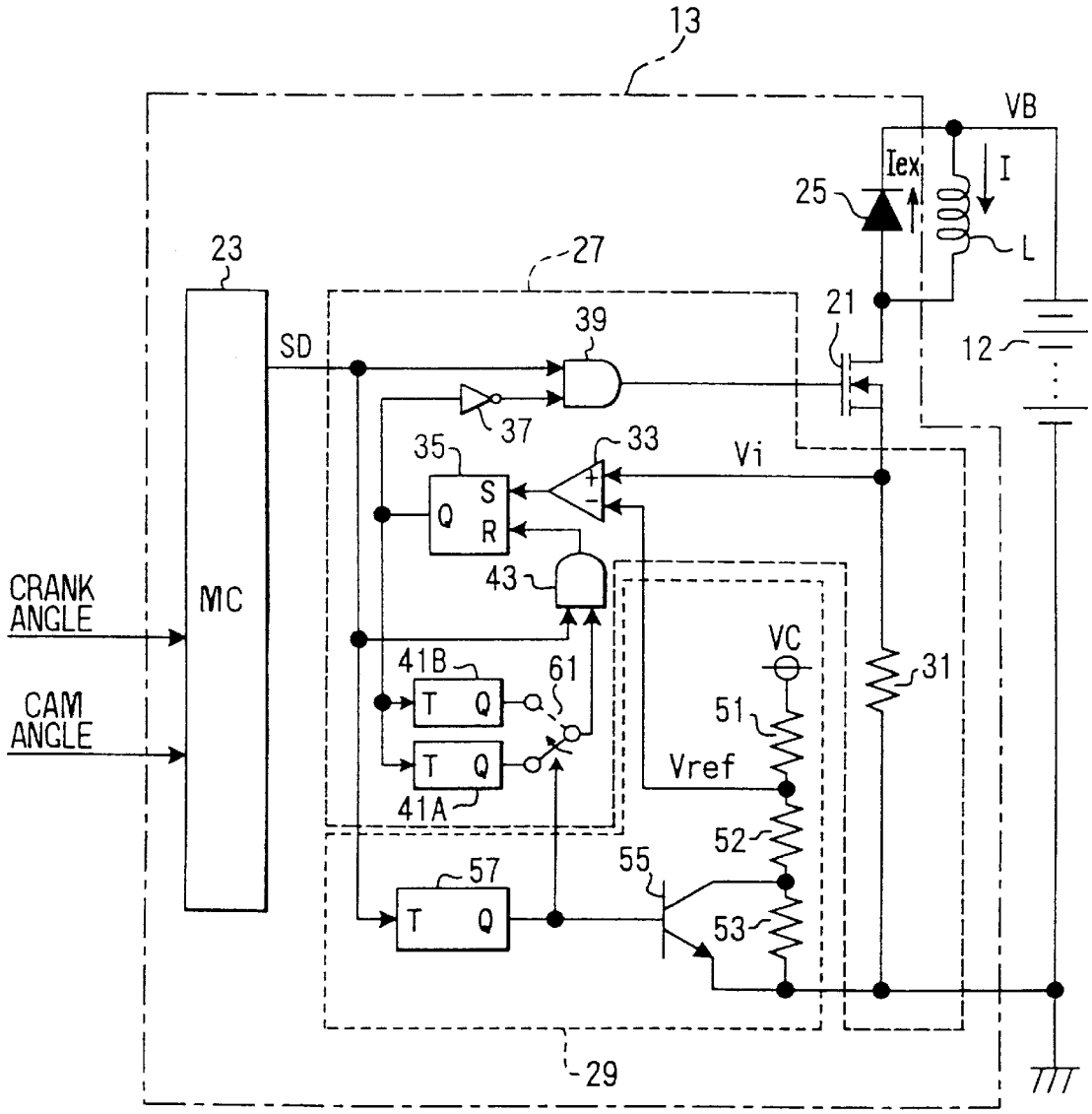
FIG. 3 is a circuit diagram showing an electronic control unit used as an electromagnetic valve driving apparatus for the system shown in FIG. 1 according to a first embodiment of the present invention.

The electronic control unit 13 according to a first embodiment includes, as shown in FIG. 3, an N-channel MOSFET 21 connected in series to the coil L on a current path for supplying a conduction current I from the battery 12 to the coil L employed in the electromagnetic valve 6. The N-channel MOSFET 21 serves as a switching device which can be turned on for supplying the conduction current I to the coil L to drive the electromagnetic valve 6. The conduction current I closes the normally-opened electromagnetic valve 6.

The electronic control unit 13 also has a microcomputer (MC) 23 for outputting a high level driving signal SD for turning on the N-channel MOSFET 21. The high level driving signal SD is output on the basis of a crankshaft rotation signal generated by a crankshaft rotation sensor of the engine to represent the rotation angle of the crankshaft (crank angle) and a camshaft rotation signal generated by a camshaft rotation sensor to represent the rotation angle of the camshaft (cam angle). The microcomputer 23 produces the driving signal SD in synchronism with a rotational angle of the crankshaft.

It should be noted that this embodiment adopts the low-side switching system wherein one end of the coil L is connected to the plus-side terminal of the battery 12 and the other end of the coil L is connected to the drain of the N-channel MOSFET 21. A diode 25 is connected between the terminals of the coil L. When the N-channel MOSFET 21 is turned off, energy accumulated in the coil L is discharged through the diode 25 as an arc-extinguishing current Iex.

Figure 4:
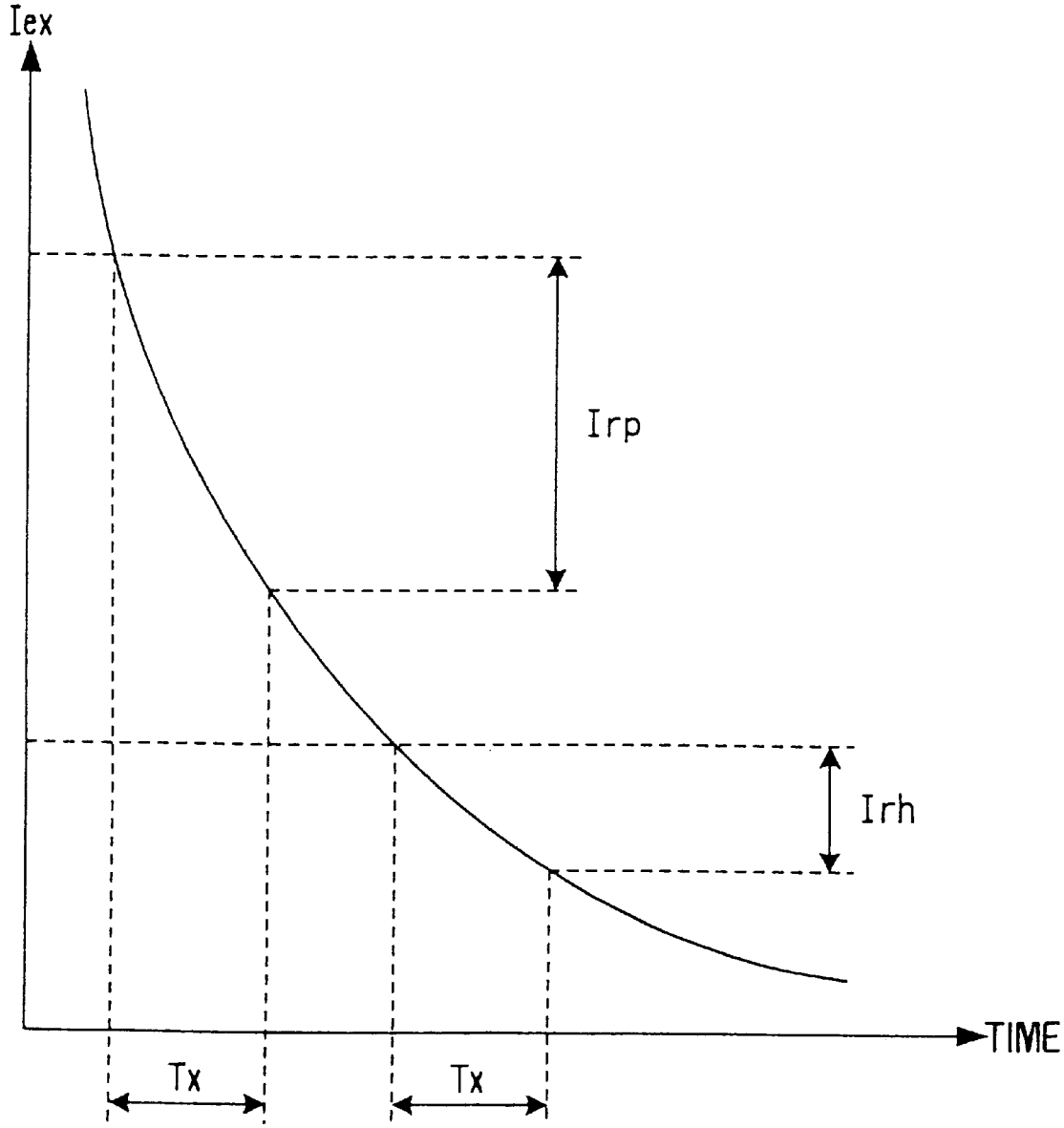
FIG. 4 is a graph showing a relationship between a time period of current conduction in a coil and a magnitude of an arc-extinguishing current in the coil.

As shown in FIG. 4, the current Iex decreases as the time passes after a change from turned-on state to turned off state of the N-channel MOSFET 21. That is, as long as the time period Tx in which the MOSFET 21 is maintained turned off is the same, a current decrease amount Irp in the case of a larger current Iex is larger than a current decrease amount Irh in the case of a smaller current Iex.

In addition, the electronic control unit 13 also includes a conduction control circuit 27 for turning on the N-channel MOSFET 21 so that the conduction current I flowing through the coil L reaches a predetermined current limit value while the microcomputer 23 is outputting the high level driving signal SD. The electronic control unit 13 further has a current-limit-value setting circuit 29 for setting a first current limit value Ip and a second current limit value Ih. Referred to as a limit corresponding to a peak current, the first current limit value Ip is a current magnitude to be reached by the conduction current I controlled by the conduction control circuit 27 during a first predetermined period T1 starting from a point of time the high level driving signal SD is output by the microcomputer 23. Referred to as a limit corresponding to a holding current, the second current limit value Ih is a current magnitude at which the conduction current I controlled by the conduction control circuit 27 is to be set after the period T1 has lapsed. The second current limit value Ih is smaller than the first current limit value Ip.

The conduction control circuit 27 comprises a current detection resistor 31, a comparator 33, a set-reset (SR) latch 35, an inverter 37, an AND gate 39, timers 41A and 41B, an AND gate 43 and a switch 61. The current detection resistor 31 is connected between the source of the N-channel MOSFET 21 and the ground or the minus terminal of the battery 12. A voltage Vi generated between the ends of the current detection resistor 31 is proportional to the conduction current I flowing through the coil L. The voltage Vi is supplied to a non-inverting (+) input terminal of the comparator 33. The output of the comparator 33 is connected to a set terminal S of the SR latch 35. The output of the SR latch 35 appearing at an output terminal Q thereof is inverted by the inverter 37. The output of the inverter 37 and the high level driving signal SD generated by the microcomputer 23 are supplied to the AND gate 39 for outputting a logical-product signal to the gate of the N-channel MOSFET 21. The output terminal Q of the SR latch 35 is also connected to input terminals T of the timers 41A and 41B.

When the SR latch 35 outputs a high level signal, the timer 41A or 41B drives its internal counter to start a counting operation. As the counting operation corresponding to a period TA or TB is completed, a signal appearing at an output terminal Q of the timer 41A or 41B is inverted to a high level. The period TA of the timer 41A is shorter than the period TB of the timer 41B. When the SR latch 35 outputs a low level signal, on the other hand, the internal counter of the timer 41A or 41B is reset and the signal appearing at the output terminal Q of the timer 41A or 41B is inverted to a low level. The signal appearing at the output terminal Q of the timer 41A or 41B and the high level driving signal SD generated by the microcomputer 23 are supplied to the AND gate 43 for outputting a signal to a reset terminal R of the SR latch 35.

On the other hand, the current-limit-value setting circuit 29 comprises three resistors 51, 52 and 53, an NPN transistor 55 and a timer 57. The timer 57 is connected to control the transistor 55 and the switch 61. The resistors 51, 52 and 53 are connected in series between a regulated power-supply voltage Vc and the ground. The power-supply voltage Vc is generated in the electronic control unit 13 from the voltage VB of the battery 12. The resistor 51 is connected to the voltage Vc side, the resistor 53 is connected to the ground side and the resistor 52 is connected between the resistors 51 and 53. A point of connection between the resistors 52 and 53 is connected to the collector of the NPN transistor 55. The other end of the resistor 53 is connected to the emitter of the NPN transistor 55 and the ground. A reference voltage Vref appearing at a point of connection between the resistors 51 and 52 can be changed by the NPN transistor 55.

The high level driving signal SD generated by the microcomputer 23 is supplied to an input terminal T of the timer 57. When the driving signal SD is raised from the low level to the high level, an internal counter in the timer 57 is reset and a low level signal is output from an output terminal Q of the timer 57 to the NPN transistor 55. At the same time, a counting operation of a time period T1 is started. As the counting operation corresponding to the period T1 set in advance is completed, the signal appearing at the output terminal Q of the timer 57 is inverted to a high level for turning on the NPN transistor 55 and for changing the connection of the switch 61 from the timer 41A to the timer 41B. The reference voltage Vref appearing at the point of connection between two of the resistors 51, 52 and 53, that is, the resistors 51 and 52, is supplied to an inverting (–) input terminal of the comparator 33 for comparing the reference voltage Vref with the voltage Vi generated by the current detection resistor 31.

In this unit 13, with the NPN transistor 55 of the current-limit-value setting circuit 29 turned off, the reference voltage Vref supplied to the inverting input terminal of the comparator 33 represents the first current limit value Ip or the magnitude of a peak current. It is assumed that the resistances of the resistors 51 to 53 are R51 to R53 respectively. In this case, the reference voltage Vref(Ip) representing the first current limit value Ip is given by the following equation:

$$Vref(Ip)=VC\times(R52+R53)/(R51+R52+R53)$$

The first current limit value Ip is a quotient determined as a result of dividing the reference voltage Vref(Ip) by the resistance of the current detection resistor 31. The first current limit value Ip is set at such a value that, for a normal battery voltage VB, during the predetermined period T1 starting from a point of time the N-channel MOSFET 21 is turned on, the conduction current I flowing through the coil L of the electromagnetic valve 6 once exceeds the first current limit value Ip, causing the operation of the valve body 6*a* of the electromagnetic valve 6 to be completed with a high degree of reliability. In the case of this embodiment, the operation of the valve body 6*a* is an operation to close the electromagnetic valve 6.

In the electronic control unit 13, when the NPN transistor 55 employed in the current-limit-value setting circuit 29 is turned on after the time period T1, one of the resistors 51 to 53, namely, the resistor 53, is short-circuited. In this state, the reference voltage Vref supplied to the inverting input terminal of the comparator 33 is a voltage Vref(Ih) corresponding to the second current limit value Ih, that is, the magnitude of a holding current. It should be noted that the reference voltage Vref(Ih) is given as follows:

$$Vref(Ih)=VC\times R52/(R51+R52)$$

The second current limit value Ih is a quotient determined as a result of dividing the reference voltage Vref(Ih) by the resistance of the current detection resistor 31. The second current limit value Ih is set at a minimum value required for sustaining the operation of the electromagnetic valve 6 in a conductive state, that is, the operation to keep the valve closed in the case of this embodiment. The second current limit value Ih is smaller than the first current limit value Ip.

Figure 5:
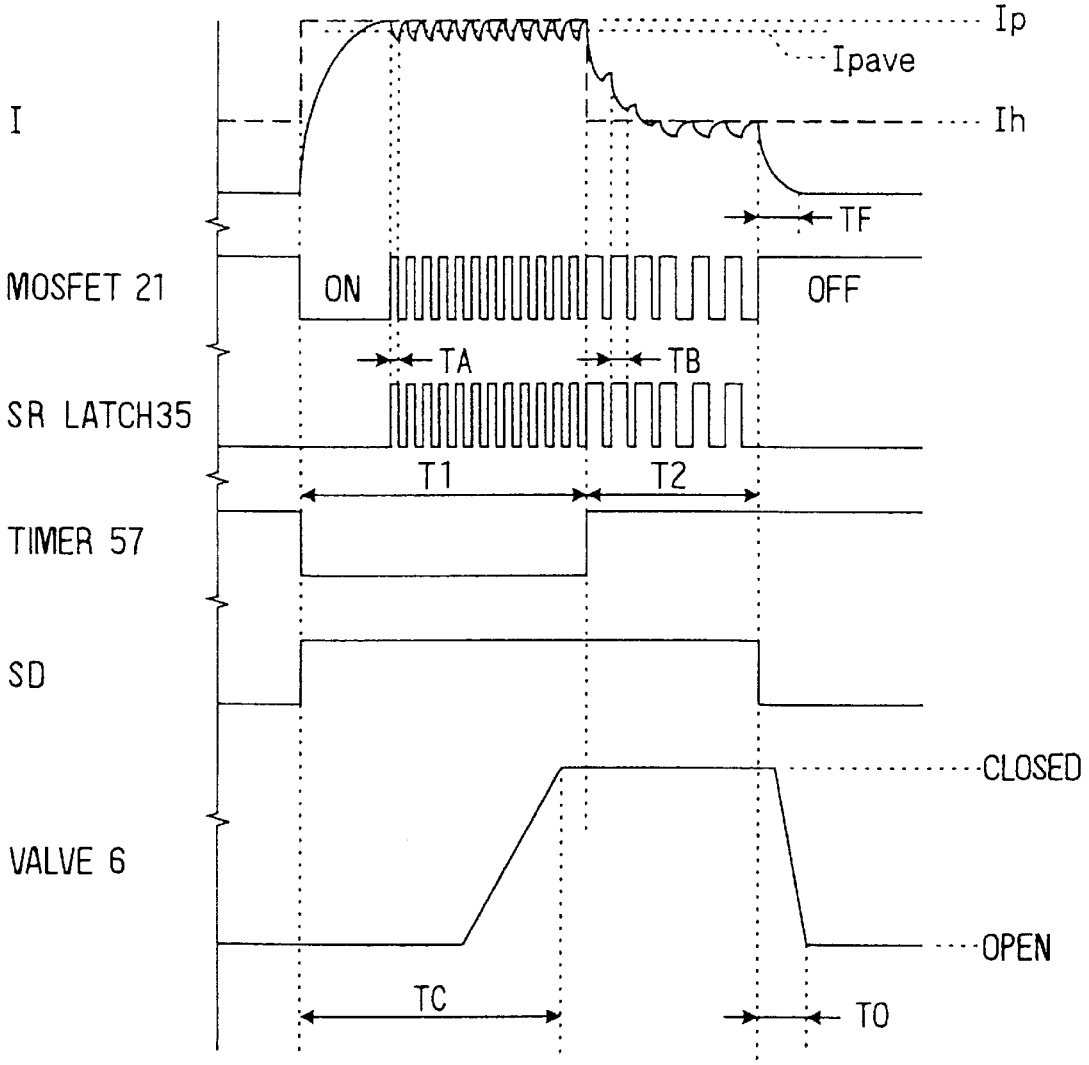
FIG. 5 is a timing diagram showing operations carried out by the electronic control unit of the first embodiment, in which an off-time of a MOSFET is varied from a short off-time to a long off-time.

In the electronic control unit 13, the comparator 33 employed in the conduction control circuit 27 compares the conduction current I flowing through the coil L with the reference voltage Vref which can be the first current limit value Ip or the second current limit value Ih. Each time the conduction current I exceeds the reference voltage Vref, the N-channel MOSFET 21 is temporarily turned off for a period TA or TB to cut off the conduction current I as shown in FIG. 5. The timers 41A and 41B employed in the conduction control circuit 27 are used for detecting the lapse of the period TA and TB, respectively. On the other hand, the timer 57 employed in the current-limit-value setting circuit 29 is used for detecting the lapse of the period T1 as measured from a point of time the high level driving signal SD is output by the microcomputer 23. As the period T1 lapses, the limit value of the conduction current I controlled by the conduction control circuit 27 is changed from the first current limit value Ip to the second current limit value Ih as shown in FIG. 5.

The operation of the first embodiment is summarized as follows with reference to FIG. 5.

During the first time period (period of the low level output from the timer 57) measured by the timer 57 from a point of time the microcomputer generates the high level driving signal SD, the switch 61 connects the timer 41A and the AND gate 43. In this period T1, the MOSFET 21 is on/off-controlled. That is, each time the comparator 33 detects that the conduction current I of the coil L reaches the first current limit value Ip, the MOSFET 21 is temporarily turned off for the first off-period TA, which is measured by the first timer 41A. As a result, the conduction current I is limited to and maintained at around the first limit current value Ip.

During the second time period T2 from the lapse of the first time period T1 to the end of the high level driving signal SD, the switch 61 connects the second timer 41B to the AND gate 43. In this second time period T2 also, the MOSFET 21 is on/off-controlled. That is, each time the comparator 33 detects that the conduction current I of the coil L reaches the second current limit value Ih, the MOSFET 21 is temporarily turned off for the second off-period TB, which is measured by the second time 41B. As a result, the conduction current I is limited to and maintained at around the second limit current value Ih.

Figure 6:
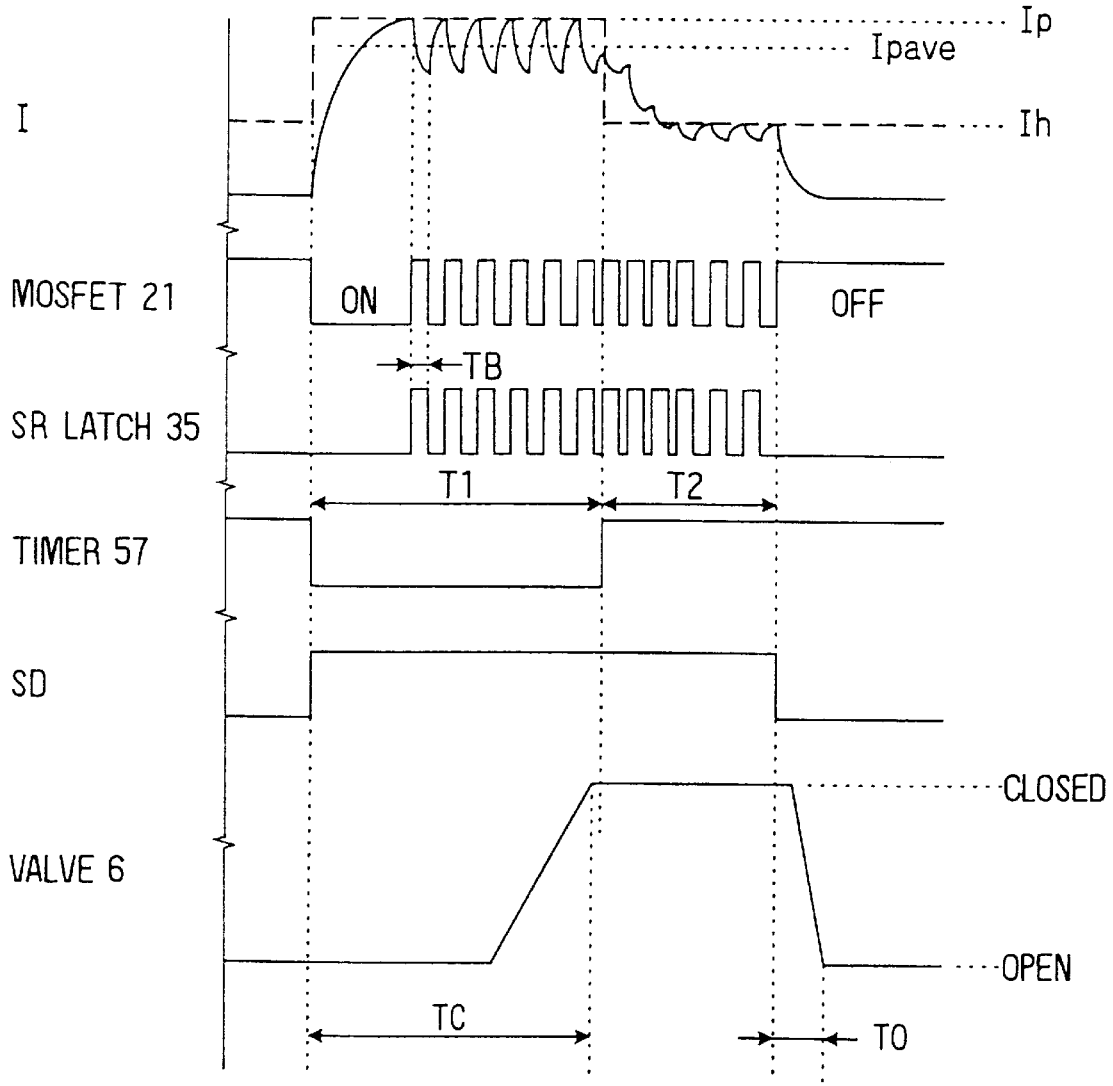
FIG. 6 is a timing diagram showing operations in the case in which the off-time of the MOSFET is uniformly set to the long off-time.

The off-times TA and TB of the MOSFET 21 measured by the timers 41A and 41B are set differently so that the first off-time TA is shorter than the second off-time TB. Therefore, the current decrease during each off-time (TA) is reduced more than that in the case of the long off-time (TB) shown in FIG. 6. In the case of FIG. 6, the off-time in the first and the second periods T1 and T2 are set uniformly to the off-time (TB). The variation of the conduction current I of the coil L in the first time period T1 is reduced so that the average conduction current Ipave is maintained more closely to the first limit current value Ip than in the case shown in FIG. 6. Thus, the valve-closing response time Tc of the electromagnetic valve 6 is more shortened than in the case of FIG. 6.

Figure 7:
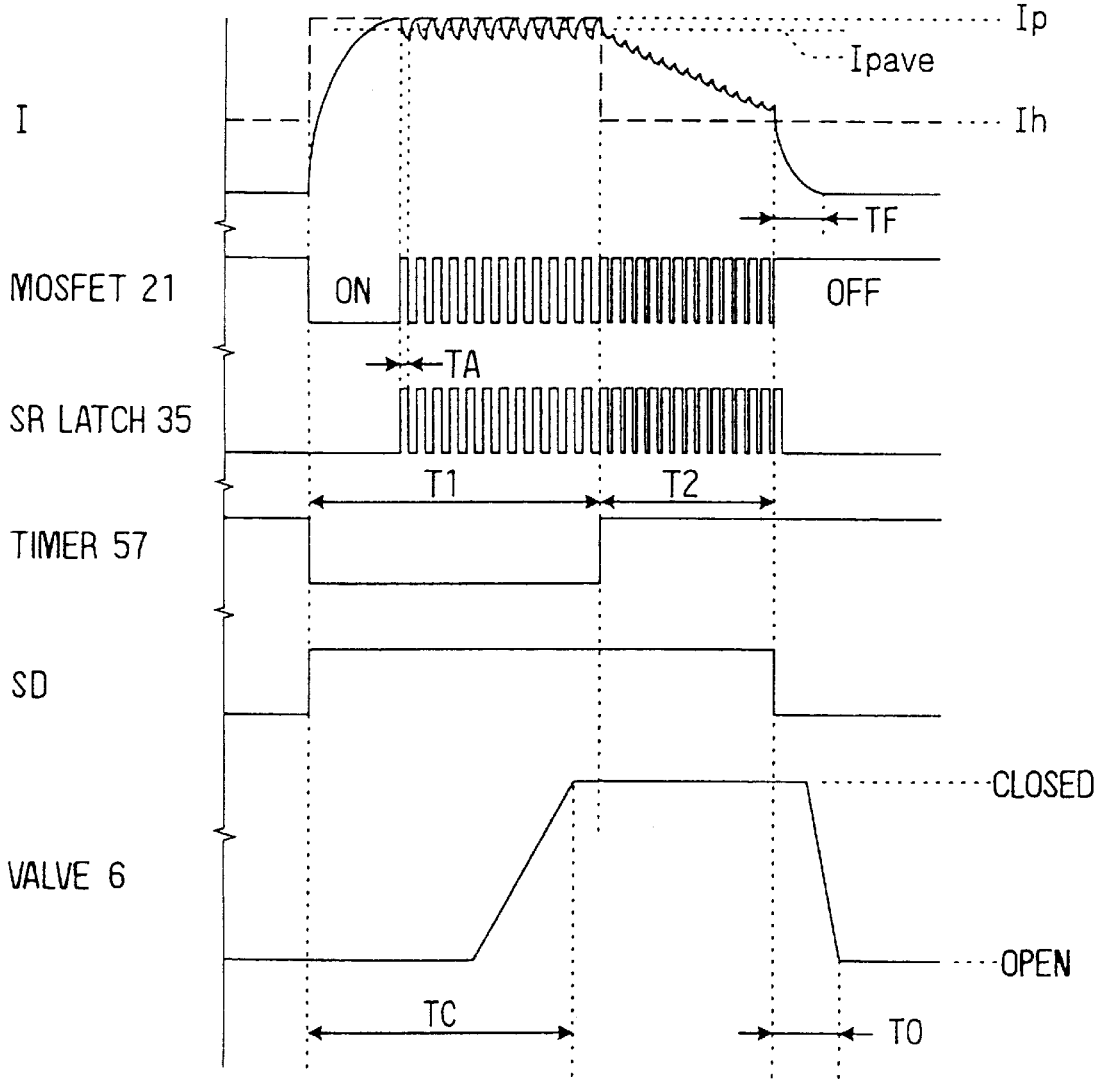
FIG. 7 is a timing diagram showing operations in the case in which the off-time of the MOSFET is uniformly set to the short off-time.

Further, the conduction current I is more sharply attenuated from the first current limit value Ip to the second current limit value Ih at a transition from the first period T1 to the second period T2 than in the case of FIG. 7 in which the off-time during the first and the second periods T1 and T2 are uniformly set to the first off-time TA. Thus, the electric power loss in the second period T2 is reduced.

Further, because the conduction current I is reduced to the second current limit value Ih within a short period of time, an arc-extinguishing period TF, in which the conduction current I is reduced from the second current limit value Ih to zero after the high level driving signal disappears, is shortened even when the second time period is shortened. As a result, the valve-opening response time TO is also more shortened than in the case of FIG. 7.

Second Embodiment

Figure 8:
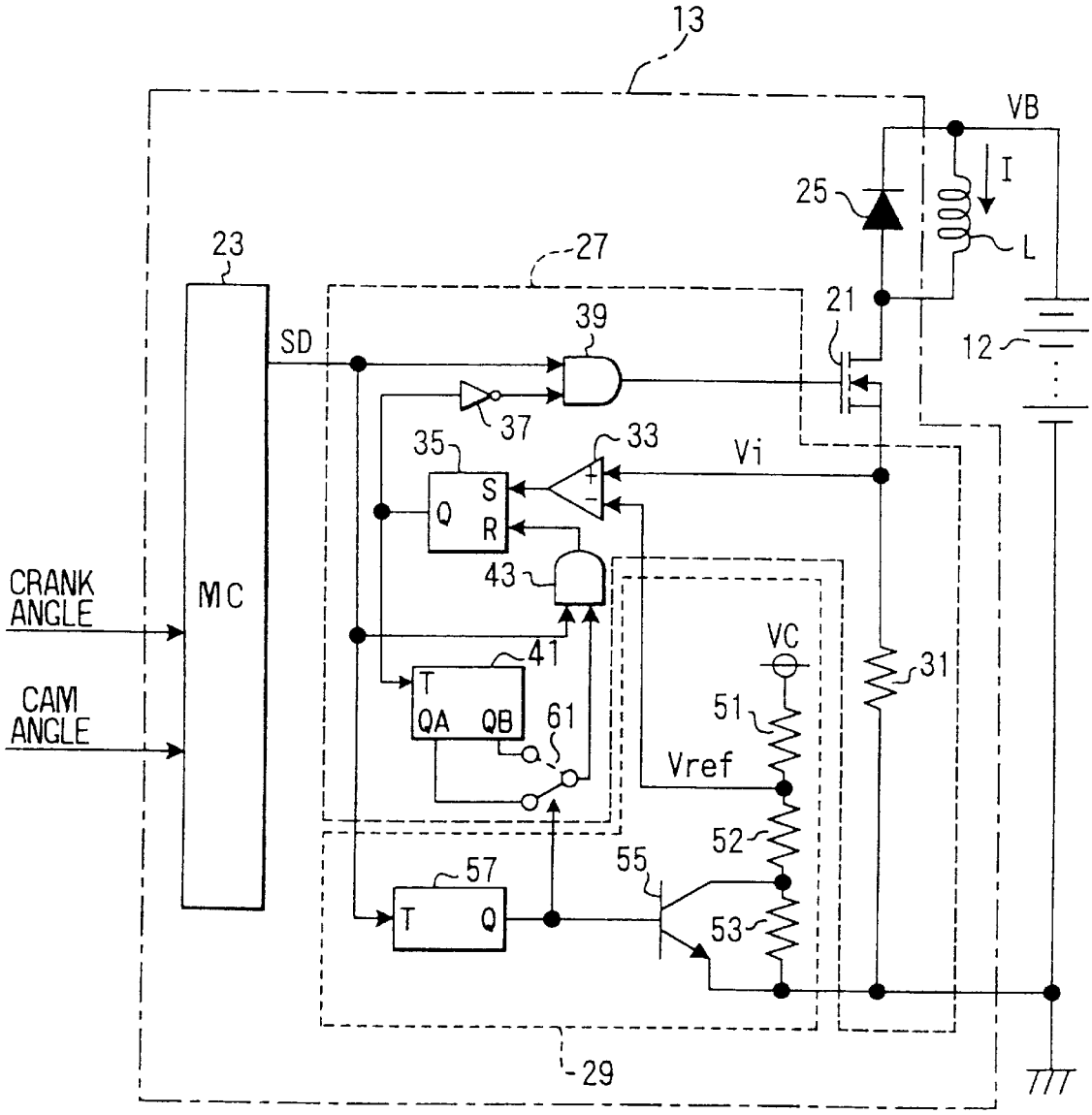
FIG. 8 is a circuit diagram showing an electronic control unit according to a second embodiment of the present invention.

In a second embodiment shown in FIG. 8, a timer 41 having two outputs QA and QB is used in place of two timers 41A and 41B of the first embodiment.

The timer 41 starts the counting operation of its internal counter in response to the high level output signal applied from the SR latch 35. It produces the high level signal from the first output terminal QA, when the first off-time TA (<TB) is counted. It then produces the high level signal from the second output terminal QB, when the second off-time TB is counted. The timer 41 resets its internal counter to produce the low level signal from the first and the second output terminals QA and QB, when the low level signal is applied from the SR latch 35. The switch 61 selectively connects the output terminals QA and QB to the AND gate 43 in response to the output signal of the timer 57, thereby to attain the same operation as the first embodiment.

Third Embodiment

Figure 9:
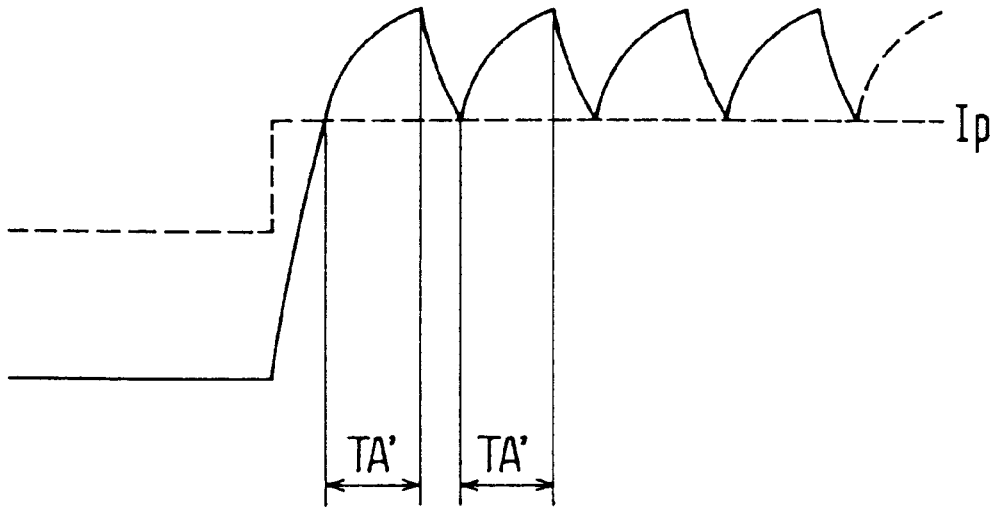
FIG. 9 is a timing diagram showing operations according to a third embodiment of the present invention.

In a third embodiment, the electronic control unit 13 is constructed to attain the control shown in FIG. 9. In this embodiment, a timer generally controls on-time of the MOSFET 21 during the first time period T1 and the second time period T2.

That is, during the first time period T1, the timer starts counting an on-time TA' of the MOSFET 21 after the conduction current I increases to the current limit value Ip for the first time after a start of the driving signal. The MOSFET 21 is maintained turned on until the timer counts a first on-time TA' thereby to maintain the conduction current I above the current limit value Ip. When the conduction current I decreases to the current limit value Ip due to the turn-off of the MOSFET 21 after the first on-time TA', the timer starts the time counting operation to repeat the above operation during the first period T1.

During the second time period T2, the current limit value is changed from Ip to Ih and the MOSFET 21 is turned on and off in the similar manner as in the first time period T1. A second on-time TB' for turning on the MOSFET 21 in the second time period T2 is set longer than the first on-time TA' in the first time period T1. As the MOSFET 21 is turned on longer, the conduction current I takes longer time to decrease to the current limit value. As a result, an off-time of the MOSFET 21 in the second time period T2 also becomes longer than that in the first time period T1.

Fourth Embodiment

Figure 10:
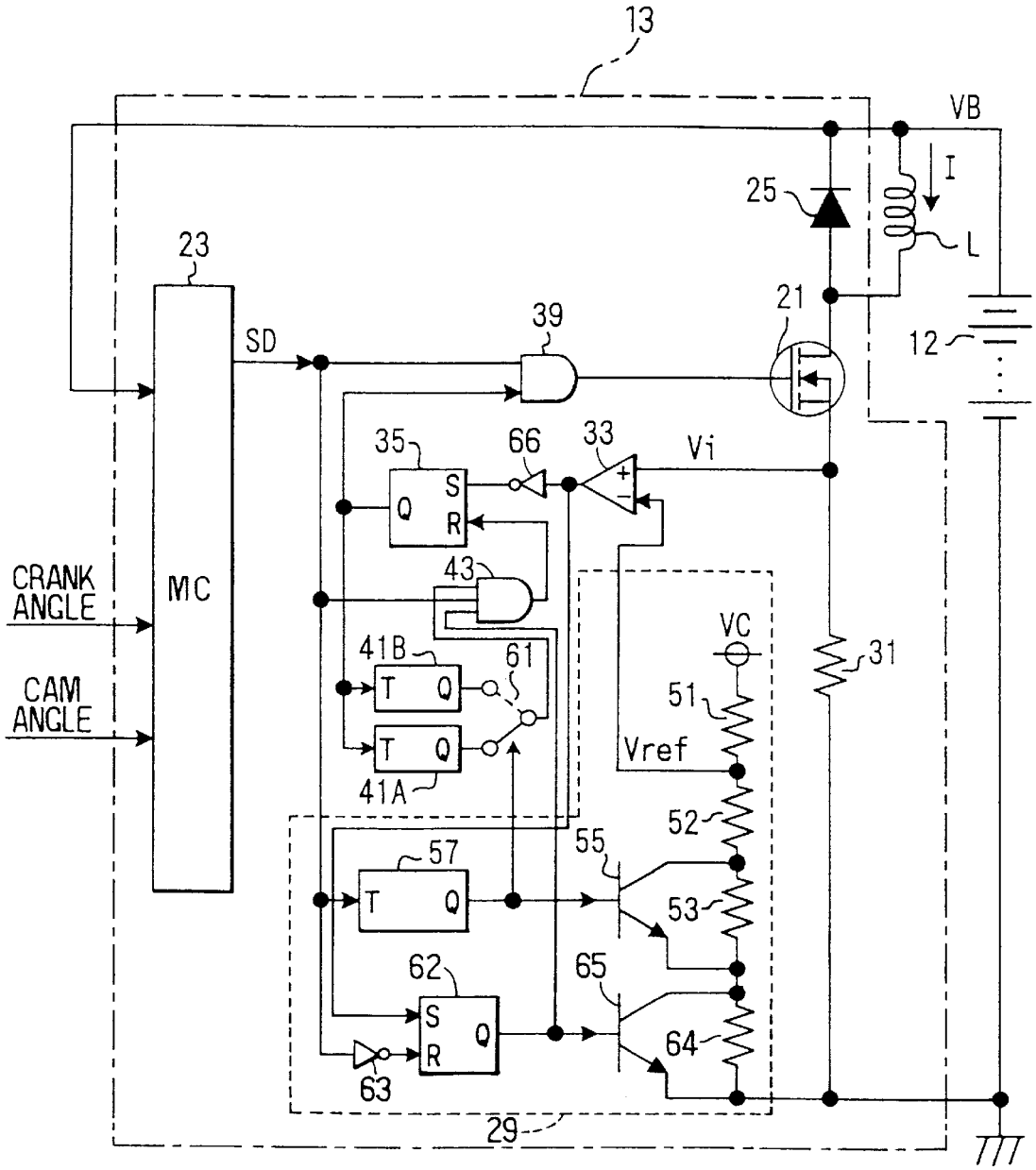
FIG. 10 is a circuit diagram showing an electronic control unit used as an electromagnetic valve driving apparatus for the system shown in FIG. 1 according to a fourth embodiment of the present invention.
Figure 11:
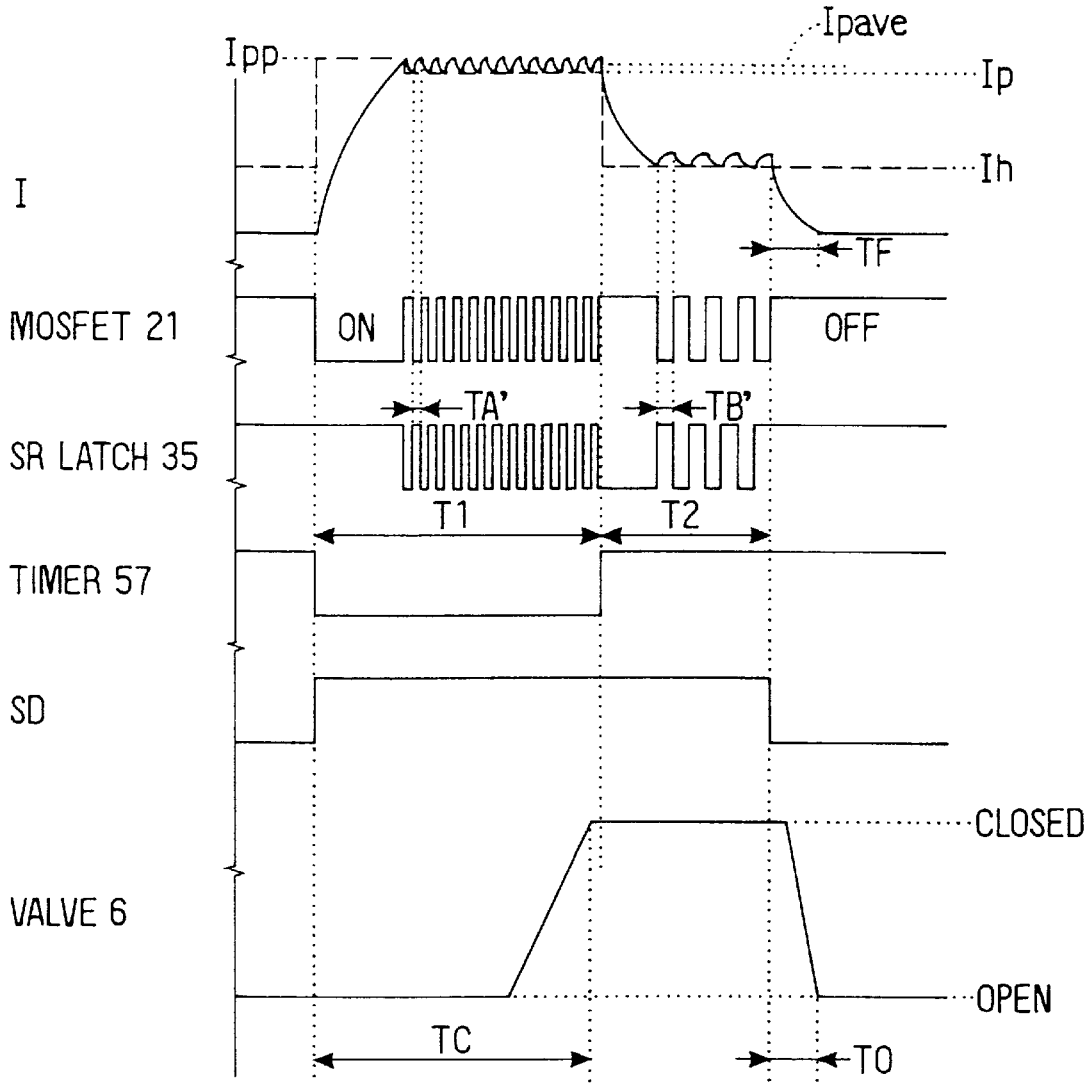
FIG. 11 is a timing diagram showing operations according to the fourth embodiment of the present invention.

In a fourth embodiment, the electronic control unit 13 is constructed as shown in FIG. 10 to attain the control shown in FIG. 11 during the first time period T1 and the second time period T2. In this embodiment also, a timer also generally controls on-time of the MOSFET 21.

That is, during the first time period T1, the current limit value is changed from Ipp to Ip because a SR latch 62 outputs high level and a transistor 65 is turned on when the conduction current I increases above the current limit value Ipp for the first time due to the first turn-on of the MOSFET 21 after the start of the driving signal. The timer 41A starts counting the on-time TA' of the MOSFET 21 after the conduction current I decreases to the lowered current limit value Ip due to the turn-off of the MOSFET 21. Subsequently, the timer 41A operates in the same manner as in the third embodiment.

During the second time period T2, the current limit value is changed from Ip to Ih because the transistor 55 is turned on and the MOSFET 21 is turned on and off in the similar manner by the timer 41B as in the first time period T1. A second on-time TB' for turning on the MOSFET 21 in the second time period T2 is set longer than the first on-time TA' in the first time period T1. As the MOSFET 21 is turned on longer, the conduction current I takes longer time to decrease to the current limit value. As a result, an off-time of the MOSFET 21 in the second time period T2 also becomes longer than that in the first time period T1.

The present invention should not be limited to the disclosed embodiments, but may be modified in many other ways.

For instance, most of the hardware construction including the conduction control circuit 27 and the current-limit-value setting circuit 29 may be implemented by the microcomputer 23. In this instance, the microcomputer 23 should be a type which includes an A/D converter for converting the voltage Vi of the resistor 31 into the corresponding digital signal for use in the processing in the microcomputer 23.

Further, the driving signal SD of the microcomputer 23 may be applied to the gate of the MOSFET 21 without the AND gate 39 and the inverter 37. In this instance, an NPN transistor may be connected between the gate of the MOSFET 21 and the ground. This NPN transistor is turned on with the high level signal of the SR latch 35 so that the MOSFET 21 may be forced to turn off.

Still further, the electromagnetic valve may be a fuel injector type, which injects fuel into the gasoline engine, or a spill valve type used in a fuel injection pump for diesel engines. It may also be any type which is not used in the fuel supply control.

What is claimed is:

1. A driving apparatus for an electromagnetic device comprising:

a switching device provided in series with the electromagnetic device for supplying a conduction current to the electromagnetic device to drive the electromagnetic device when turned on;

conduction period setting means for setting a conduction period of the electromagnetic device, the conduction period includes a first conduction period and a second conduction period following the first conduction period; and conduction control means for repeatedly turning on and off the switching device so as to set the conduction current at around a first predetermined current limit value during the first period of the conduction period, for repeatedly turning on and off the switching device so as to set the conduction current at around a second predetermined current limit value smaller than the first predetermined current limit value during the second period of the conduction period following the first period, and for completely turning off the switching device after the conduction period irrespective of the conduction current;

wherein an on/off-time of the switching device in the second period is set longer than that in the first period.

2. The driving apparatus according to claim 1, wherein:

the switching device is turned on at a time of start of the conduction period;

the switching device is turned off for a first predetermined off-time and a second predetermined off-time each time the conduction current reaches the first predetermined current limit value and the second predetermined current limit value during the first conduction period and the second conduction period, respectively; and the second off-time is set longer than the first off-time.

3. The driving apparatus according to claim 1, wherein:

the switching device is turned on at a time of start of the conduction period;

the switching device is turned on for a first predetermined on-time and a second predetermined on-time each time the conduction current decreases to the first predetermined current limit value and the second predetermined current limit value during the first conduction period after reaching the first current limit value and the second conduction period, respectively; and the second on-time is set longer than the first on-time.

4. The driving apparatus according to claim 1, wherein:

the switching device is turned on at a time of start of the conduction period until the conduction current reaches a predetermined third current limit value set to be larger than the second current limit value;

the switching device is turned on for a first predetermined on-time and a second predetermined on-time each time the conduction current decreases to the first predetermined current limit value and the second predetermined current limit value during the first conduction period after reaching the third current limit value and the second conduction period, respectively; and the second on-time is set longer than the first on-time.

5. The driving apparatus according to claim 1, wherein:

the electromagnetic device includes a coil for moving a valve body.

6. The driving apparatus according to claim 5, wherein:

the conduction period setting means produces a driving signal during the predetermined conduction period; and the conduction control means includes;

checking means for checking whether the conduction current of the coil is above or below a reference value, limit-current-value setting means for setting the reference value to the first limit current value and the second limit current value during the first predetermined period and the second predetermined value, respectively;

driving means for turning on t he switching device during the driving signal;

conduction current limit means for disabling the driving means to turn on the switching device for a predetermined off-time when the check means indicates that the conduction current reaches the reference value so that the switching device is forced to turn off, and off-time changing means for setting the predetermined off-time to the first off-time and the second off-time during the first period and the second period, respectively.

7. The driving apparatus according to claim 6, wherein:

the conduction current limit means includes;

a first timer for counting the first off-time when the check means indicates that the conduction current reaches the reference value, and produces a first signal indicative of a lapse of the first off-time when the first off-time is counted, a second timer for counting the second off-time when the check means indicates that the conduction current reaches the reference value, and produces a second signal indicative of a lapse of the second off-time when the second off-time is counted, and inhibition means for inhibiting the driving means from driving the switching means until one of the first signal and the second signal is applied, when the check means indicates that the conduction current reaches the reference value; and the off-time change means applies, to the inhibition means, the first signal during the first period from a start of the driving signal, and the second signal during the second period following the first period until an end of the driving signal.

8. The driving apparatus according to claim 6, wherein:

the conduction current limit means includes;

a timer for counting the first off-time when the check means indicates that the conduction current reaches the reference value and produces a first signal indicative of a lapse of the first off-time when the first off-time is counted, and for counting the second off-time after a lapse of the first off-time and produces a second signal indicative of a lapse of the second off-time when the second off-time is counted, and inhibition means for inhibiting the driving means from driving the switching means until one of the first signal and the second signal is applied, when the check means indicates that the conduction current reaches the reference value; and the off-time change means applies, to the inhibition means, the first signal during the first period from a start of the driving signal, and the second signal during the second period following the first period until an end of the driving signal.

9. The driving apparatus according to claim 1, wherein:

the electromagnetic device is a type which controls fuel supply to an engine; and the conduction period setting means sets the conduction period in timed relation with a rotation of the engine.

10. The driving apparatus according to claim 9, wherein the electromagnetic device is mounted on a high pressure fuel pump which regulates pressure of fuel supplied to the engine.

11. The driving apparatus according to claim 9, wherein the electromagnetic device is mounted on the engine as a fuel injection valve for injecting fuel therefrom.

* * * * *